US010794244B2

(12) United States Patent
Yoo et al.

(10) Patent No.: US 10,794,244 B2
(45) Date of Patent: Oct. 6, 2020

(54) METHOD AND SYSTEM FOR CRANKCASE VENTILATION MONITOR

(71) Applicant: Ford Global Technologies, LLC, Dearborn, MI (US)

(72) Inventors: In Kwang Yoo, Ann Arbor, MI (US); Michiel J. Van Nieuwstadt, Ann Arbor, MI (US); Rui Chen, Farmington, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 50 days.

(21) Appl. No.: 16/273,967

(22) Filed: Feb. 12, 2019

(65) Prior Publication Data

US 2020/0256224 A1 Aug. 13, 2020

(51) Int. Cl.

| | |
|---|---|
| ***F01M 13/00*** | (2006.01) |
| ***F01M 1/18*** | (2006.01) |
| ***F02D 41/22*** | (2006.01) |
| *F02D 41/06* | (2006.01) |
| *F02N 11/10* | (2006.01) |

(52) U.S. Cl.

CPC ..... *F01M 13/0011* (2013.01); *F01M 1/18* (2013.01); *F01M 2013/0038* (2013.01); *F01M 2013/0083* (2013.01); *F01M 2013/0088* (2013.01); *F01M 2013/0094* (2013.01); *F02D 41/062* (2013.01); *F02D 41/22* (2013.01); *F02N 11/10* (2013.01)

(58) Field of Classification Search

CPC ..... F01M 13/0011; F01M 1/18; F01M 2013/0038; F01M 2013/0083; F01M 2013/0088; F01M 2013/0094; F02D 41/062; F02D 41/22; F02N 11/10

See application file for complete search history.

(56) References Cited

U.S. PATENT DOCUMENTS

| | | | | |
|---|---|---|---|---|
| 6,240,772 | B1 * | 6/2001 | Thomas | G01M 15/09 73/114.01 |
| 8,789,517 | B2 | 7/2014 | Narita | |
| 2013/0282255 | A1 | 10/2013 | Pursifull | |
| 2014/0081550 | A1 | 3/2014 | Jentz et al. | |
| 2014/0081564 | A1 * | 3/2014 | Pursifull | G01M 15/08 701/113 |
| 2014/0149015 | A1 | 5/2014 | Pursifull | |
| 2016/0024983 | A1 | 1/2016 | Jones et al. | |
| 2016/0097355 | A1 * | 4/2016 | Jentz | F02M 35/1038 701/102 |
| 2017/0234178 | A1 * | 8/2017 | Mosher | F01M 13/0011 123/574 |
| 2018/0306074 | A1 * | 10/2018 | Kayama | F02M 25/0827 |

FOREIGN PATENT DOCUMENTS

| | | | |
|---|---|---|---|
| JP | 2003074420 | A | 3/2003 |

* cited by examiner

*Primary Examiner* — Jacob M Amick

(74) *Attorney, Agent, or Firm* — Geoffrey Brumbaugh; McCoy Russell LLP

(57) ABSTRACT

Methods and systems are provided for indicating crankcase breach due to disconnection of a crankcase vent tube from an engine on a clean air side or broken crankcase vent tube. In one example, a maximum possible change in crankcase vent tube pressure is estimated for each pedal transient of a drive cycle. The change for a plurality of transients in averaged and compared to a threshold to identify vent tube disconnection.

20 Claims, 9 Drawing Sheets

METHOD AND SYSTEM FOR CRANKCASE VENTILATION MONITOR

FIELD

The present description relates generally to methods and systems for diagnosing breach in crankcase ventilation in an engine system.

BACKGROUND/SUMMARY

Engines may include crankcase ventilation systems to vent gases out of the crankcase and into an engine intake manifold to provide continual evacuation of gases from inside the crankcase in order to reduce degradation of various engine components in the crankcase. Blow-by gas generated in the crankcase, which consists of air, combustion gas, and unburned fuel, is cleaned at an oil separator and introduced to an engine air intake passage, downstream of an air filter, via a crankcase ventilation tube (CVT). The crankcase gases introduced via the CVT are then combusted in the engine cylinders. If the CVT becomes disconnected or broken while the engine is running, the blow-by gas is released, degrading emissions.

Crankcase ventilation systems may be intermittently diagnosed. For example, crankcase breach due to disconnection of the CVT or degradation of the PCV valve may be identified. One example monitor is shown by Jentz et al in U.S. Pat. No. 9,068,486. Therein, crankcase breach is identified based on a transient dip in crankcase vent tube pressure, sensed during engine cranking from rest during an engine restart. In other approaches, a plurality of absolute sensors, e.g., a barometric pressure sensor (BP), a compressor inlet pressure sensor (CIP), a throttle inlet pressure sensor (TIP), a manifold air pressure sensor (MAP), etc., may be used in combination to monitor crankcase ventilation system integrity.

However, the inventors herein have recognized potential issues with such an approach. As an example, the efficiency of the approach may vary with the design of the engine. For example, the approach described in U.S. Pat. No. 9,068,486 may have a higher success rate with a boosted gasoline engine but may not work with a boosted diesel engine. As one example, CV (Crankcase Ventilation) pressure dip at engine crank may not be sufficiently large to reliably differentiate between no crankcase breach case and breached scenarios. Further, even if a dip is measured, it may not indicate what kind of breach is present, or the location of the breach. Furthermore, the trend of CV pressure drop at increasing air flow with crankcase breach at the side of the vent tube may be very similar to a no crankcase breach case. Therefore, detection of breach at the side of vent may not be feasible with a boosted diesel engine.

The inventors herein have further recognized that when there is a large change in an engine's air flow rate during a pedal transient (such as during a large tip-in), the large air flow transient can increase blow-by vapor flow to the engine via the CVT tube. If the hose is configured to be non-detachable at the side connecting to oil separator (i.e., at the side of vent), only breach at the side connecting to intake air may occur, and this may be accurately monitored based on changes in vent tube pressure. Thus by correlating manifold air flow changes with crankcase ventilation pressure changes, disconnection of the tube at the clean air side of the crankcase can be reliably identified.

In one example, a method for diagnosing breach in an engine crankcase ventilation system comprises, following each of a first set of qualifying pedal transients of a drive cycle, updating a minimum and maximum value of crankcase pressure; following each of a second set of qualifying pedal transients of the drive cycle, learning a pressure difference between a last updated minimum and maximum value of crankcase pressure; and indicating degradation in crankcase ventilation based on an average pressure difference over the second set. In this way, existing sensors can be used for monitoring crankcase breach.

For example, an engine crankcase ventilation system may include a crankcase vent tube coupled between crankcase and upstream of compressor in a boosted engine. A pressure sensor may be positioned within the crankcase vent tube for providing an estimate of flow or pressure of air flowing through the vent tube (herein referred to as the crankcase ventilation pressure or CV pressure). The crankcase may be coupled to the air intake passage downstream of an air filter and a manifold air flow (MAF) sensor, and upstream of the compressor. During a drive cycle, a controller may update maximum and minimum pressure thresholds for the CV pressure sensor each time there is a qualifying transient which may include a pedal transient that provides a significant change in MAF. The pedal transient may include a tip-in or tip-out occurring while engine operating conditions allow for a larger than or less than threshold manifold air flow to be observed (such as when MAF experiences outside of a defined range). The controller may then estimate a delta pressure, or pressure range, of the CV pressure sensor as engine air flow experience minimum and maximum thresholds, for each qualifying transient event. Based on an average delta pressure, averaged over each transient event of the drive cycle, in relation to a threshold, it may be determined if crankcase breach has occurred. In particular, a higher than threshold average delta pressure may be indicative of the CVT being connected at the engine intake, and crankcase gases being successfully pulled through the tube into the engine, upstream of the compressor. In comparison, a lower than threshold average delta pressure may be indicative of the CVT being disconnected or broken tube at the clean air side due to no pulling of air from via operation of the compressor.

Additionally or optionally, the controller may further diagnose crankcase breach based on a mean CV pressure and mean MAF sensed over a duration while MAF is elevated. When MAF is greater than a threshold, which occurs at pedal tip-in, mean value of MAF reading and also mean value of CV pressure reading can be calculated for a certain duration of time. For example, for a duration of 3 sec. If one tip-in event is longer than certain duration (i.e., longer than 3 sec), the calculation of mean value of CV pressure and mean MAF during initial 3 sec can be used to determine monitor result. If in other case, when a tip-in even is shorter and duration of MAF greater than a threshold does not last required duration, multiple tip-in events can be combined to fulfill total desired (i.e., 3 sec in this example) duration of mean value calculation before monitor result determination. By comparing the mean CV pressure to a threshold based on the mean MAF value, disconnection at the clean air side may be identified. In particular, a higher than threshold CV pressure may be indicative of the CVT being disconnected at the engine intake. By using mean value of CV pressure and MAF, monitor result becomes reliable and can avoid false detection from noisy signals that may often stems from high transient pedal tip-in maneuver. Having a threshold based on mean MAF provide opportunity of better separation between and healthy and breached CVT system, especially, when monitor result determination is done at higher mean MAF regime. At higher mean MAF regime, pulling of blow-by gas into engine intake is more, hence CV pressure reads lower value if CVT system is healthy and connected. However, when CVT system is breached (i.e., either broken or disconnected at the clean air side) blow-by gas is not pulled in, which makes CV pressure read higher. Therefore, at higher MAF where the pulling of blow-by gas is stronger, the difference of CV pressure reading between healthy and breached CVT is larger, which helps provide better separation of readings.

In this way, disconnection of a crankcase vent tube from the engine air intake passage may be diagnosed reliably without having false monitor determination. The methodology presented requires to have CV pressure sensor added and installed as close as possible to the oil separator side so that the breach of CVT can be monitored to its entire full length. The approach also enables breach that occurs at any time over a drive cycle to be identified when a certain level of pedal tip-in and tip-out occurs. Further, the approach enables the crankcase ventilation system to remain active during a diagnostic procedure.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
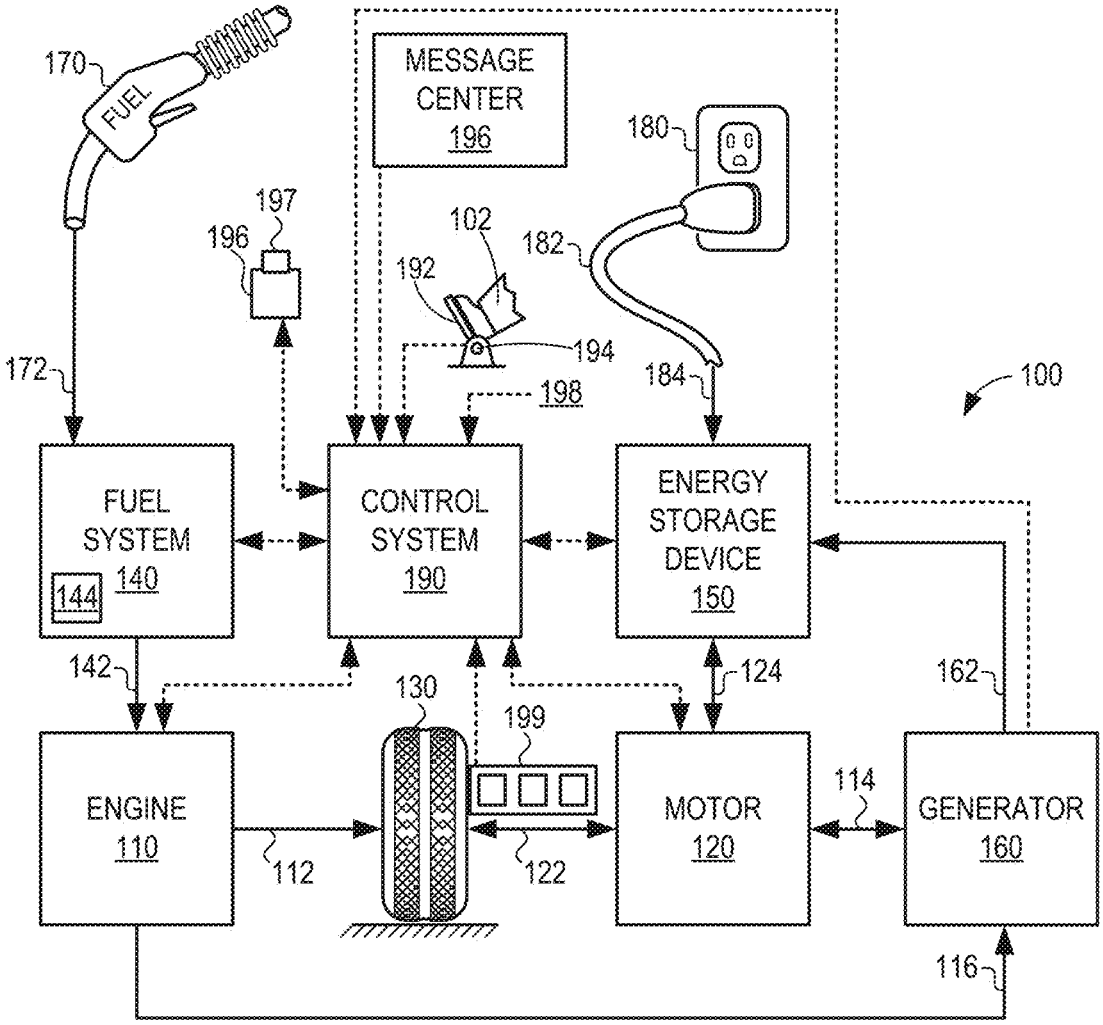
FIG. 1 shows an example hybrid electric vehicle propulsion system.
Figure 2:
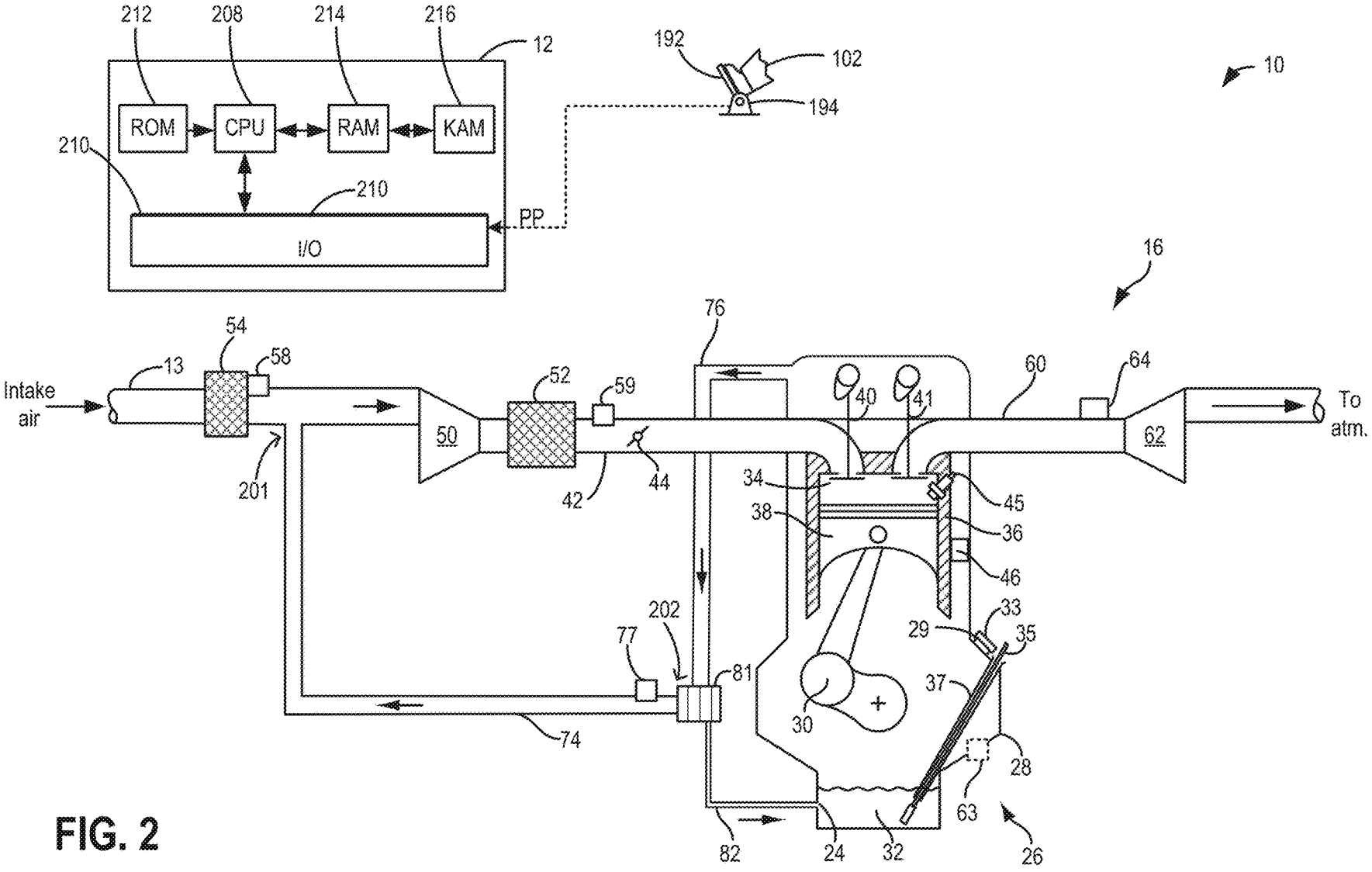
FIG. 2 shows a partial engine view in accordance with the disclosure.

The following description relates to systems and methods for monitoring crankcase ventilation system integrity in an engine crankcase ventilation system, such as the system of FIG. 2, coupled in the vehicle system of FIG. 1. An engine controller may be configured to perform a control routine, such as the example routine of FIG. 3, to indicate crankcase ventilation system degradation based on changes in crankcase vent tube pressure relative to changes in manifold air flow during engine running. Example correlations are shown at FIGS. 4-8. An example scenario is shown at FIG. 9.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle, such as from solar or wind energy. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

Referring now to FIG. 2, it shows an example system configuration of a multi-cylinder internal combustion engine, generally depicted at 10, which may be included in a propulsion system of an automotive vehicle. In one example, engine 10 includes engine 110 of FIG. 1 in vehicle system 100 of FIG. 1.

Engine 10 may be controlled at least partially by a control system including controller 12 and by input from a vehicle operator 102 via an input device 192. In this example, input device 192 includes an accelerator pedal or a brake pedal and a pedal position sensor 144 for generating a proportional pedal position signal PP.

Engine 10 may include a lower portion of the engine block, indicated generally at 26, which may include a crankcase 28 encasing a crankshaft 30 with oil well 32 positioned below the crankshaft. An oil fill port 29 may be disposed in crankcase 28 so that oil may be supplied to oil well 32. Oil fill port 29 may include an oil cap 33 to seal oil port 29 when the engine is in operation. A dip stick tube 37 may also be disposed in crankcase 28 and may include a dipstick 35 for measuring a level of oil in oil well 32. An opening 24 in crankcase 28 may return oil, separated from blow-by gases at oil separator 81, to oil well 32 via oil return passage 82. In addition, crankcase 28 may include a plurality of other orifices for servicing components in crankcase 28. These orifices in crankcase 28 may be maintained closed during engine operation so that a crankcase ventilation system (described below) may operate during engine operation.

The upper portion of engine block 26 may include a combustion chamber (i.e., cylinder) 34. The combustion chamber 34 may include combustion chamber walls 36 with piston 38 positioned therein. Piston 38 may be coupled to crankshaft 30 so that reciprocating motion of the piston is translated into rotational motion of the crankshaft. Combustion chamber 34 may receive fuel from fuel injector 45 (configured herein as a direct fuel injector) and intake air from intake manifold 42 which is positioned downstream of throttle 44. The engine block 26 may also include an engine coolant temperature (ECT) sensor 46 input into an engine controller 12 (described in more detail below herein).

A throttle 44 may be disposed in the engine intake to control the airflow entering intake manifold 42 and may be preceded upstream by compressor 50 followed by charge air cooler 52, for example. An air filter 54 may be positioned upstream of compressor 50 and may filter fresh air entering intake passage 13. The intake air may enter combustion chamber 34 via cam-actuated intake valve system 40. Likewise, combusted exhaust gas may exit combustion chamber 34 via cam-actuated exhaust valve system 41. In an alternate embodiment, one or more of the intake valve system and the exhaust valve system may be electrically actuated.

Exhaust combustion gases exit the combustion chamber 34 via exhaust passage 60 located upstream of turbine 62. An exhaust gas sensor 64 may be disposed along exhaust passage 60 upstream of turbine 62. Turbine 62 may be equipped with a waste-gate (not shown) bypassing it. Sensor 64 may be a suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Exhaust gas sensor 64 may be connected with controller 12.

In the example of FIG. 2, a crankcase ventilation (CV) system 16 is coupled to the engine intake so that blow-by gases in the crankcase (which consists of a mixture of air, unburned fuel, and combustion gases) may be vented in a controlled manner from the crankcase. The blow-by gas at the crankcase is introduced into the intake passage 42, downstream of MAF sensor 58 and air filter 54, via breather or crankcase vent tube (CVT) 74. In particular, blow-by gases are first directed to oil separator 81 along ventilation passage 76. Oil is separated from the blow-by gas and returned to oil well 32 via oil return passage 82 while blow-by gases cleaned of oil are directed to the engine intake via vent tube 74.

A first side 201 of crankcase vent tube 74 may be mechanically coupled, or connected, to fresh air intake passage 13 upstream of compressor 50. In some examples, the first side 201 of crankcase ventilation tube 74 may be coupled to intake passage 13 downstream of air cleaner 54 (as shown). A second, opposite side 202 of crankcase ventilation tube 74 may be designed to be permanently coupled to the oil separator. In other words, CVT 74 cannot be disconnected at second side 202, at the oil separator. As a result, the CVT 74 may break if disconnected at the second side. In contrast, the clean air side 201 of the vent tube can be disconnected without breaking, to allow repair. Consequently any indication of crankcase breach would imply disconnection at the first side 201. Due to the proximity to the air intake passage, the first side 201 may herein also be referred to as the clean air side or clean side. Due to the proximity to the oil separator, the second side 202 may herein also be referred to as the dirty air side or dirty side. If the crankcase vent tube 74 is disconnected and the engine runs, there is a possibility that the blow-by gases can be released to the air causing air pollution. Therefore, CVT 74 may be periodically diagnosed for disconnection, as elaborated at FIG. 3.

Crankcase vent tube 74 further includes a pressure sensor 77, the pressure sensor herein also referred as CV (Crankcase Ventilation) pressure sensor, coupled therein for providing an estimate about the pressure of air flowing through crankcase vent tube 74. CV Pressure sensor 77 may be an absolute pressure sensor or a gauge sensor. In an alternate embodiment, CV pressure sensor 77 may be a flow sensor or flow meter. In still another embodiment, sensor 77 may be configured as a venturi. The inventors herein have recognized that by positioning CV pressure sensor 77 in the crankcase vent tube 74, a breach in crankcase system integrity can be detected at high engine air flow conditions. This allows crankcase system degradation (such as, broken tube or blocked blow-by gas flow passage) to be identified more accurately and reliably while also enabling confirmation of disconnection of the vent tube at the clean air side, that is, at a location upstream of an intake compressor and downstream of an air filter. As elaborated with reference to FIG. 3, a controller may measure a maximum possible change in CV pressure over each pedal transient of a drive cycle. The monitor can be enabled once engine reaches to RUN State (i.e., engine speed is greater than cranking speed) and if there is no failure in MAF and CV pressure sensor. The controller may initiate monitoring of CV pressure and keep updating maximum and minimum CV pressure readings as driving progresses. Minimum CV pressure reading and update occur with pedal tip-in when engine is boosted enough, while maximum pressure reading and update occur with pedal tip-out when engine is not boosted. The criteria of an engine experienced necessary states of both boosted enough and non-boosted condition are determined by using MAF sensor reading. If the MAF sensor reading is greater than a high threshold, it indicates engine has experienced enough boosting. If the MAF sensor reading is less than a low threshold, it indicates non-boosted condition is experienced. Meeting both of low and high thresholds criteria provide for the CV pressure sensor to have a chance to update necessary minimum and maximum CV pressures readings By comparing the maximum measured pressure value to the minimum measured pressure value, a delta pressure corresponding to a widest pressure range achieved on the transient is determined. By then comparing this pressure range to a threshold, the controller may infer if the vent tube is breached (e.g., disconnected or broken). In particular, if the tube is disconnected on the clean air side, the pressure change may be smaller due to blow-by gases not being drawn in by air flowing through the intake compressor. Multiple transient events can be monitored to calculate average delta pressure from multiple delta pressure estimations. Using average delta pressure for fail or pass decision provides more reliable monitor results.

In addition to average CV delta pressure, other metrics that may be used to diagnose the CVT include mean CV pressure at high MAF conditions. When an engine experiences enough boost, which can be determined by MAF reading greater than a threshold, both of mean values of CV pressure and MAF can be estimated for a predetermined time duration. The duration may be satisfied in one long tip-in engine boosting event or over multiple short tip-in boosting events. Once estimation of mean CV pressure and mean MAF is completed, mean CV pressure can be compared to a threshold curve, whose curve is dependent on mean MAF. If mean CV pressure is less than the threshold, monitor may determine no breach in the CV system. Otherwise, monitor can determine a breached CV system. When the determination is assessed at larger mean MAF, which is when high engine boosted conditions occur, separation between breached and non-breached CV system is larger and allows for a more reliable monitor determination.

It will be appreciated that since the pressure sensor in the vent tube is used to infer or estimate the presence of air flow through the vent tube, the pressure sensor can also be used as (or interchanged with) a flow meter or a gauge.

Controller 12 is shown in FIG. 2 as a microcomputer, including microprocessor unit 208, input/output ports 210, an electronic storage medium for executable programs and calibration values shown as read only memory chip 212 in this particular example, random access memory 214, keep alive memory 216, and a data bus. Controller 12 may receive various signals from sensors coupled to engine 10, including measurement of inducted mass air flow (MAF) from mass air flow sensor 58; engine coolant temperature (ECT) from temperature sensor 46; exhaust gas air/fuel ratio from exhaust gas sensor 64; crankcase vent tube pressure sensor 77, BP sensor 57, TIP sensor 59, etc. Furthermore, controller 12 may monitor and adjust the position of various actuators based on input received from the various sensors. These actuators may include, for example, throttle 44, intake and exhaust valve systems 40, 41. Storage medium read-only memory 212 can be programmed with computer readable data representing instructions executable by processor 208 for performing the methods described below, as well as other variants that are anticipated but not specifically listed. Example methods and routines are described herein with reference to FIG. 3. For example, responsive to MAF sensor output being indicative of air flow being outside of a threshold range, the controller may measure CV pressure over a duration of each pedal transient of a drive cycle, including for each pedal tip-in and tip-out.

Figure 3:
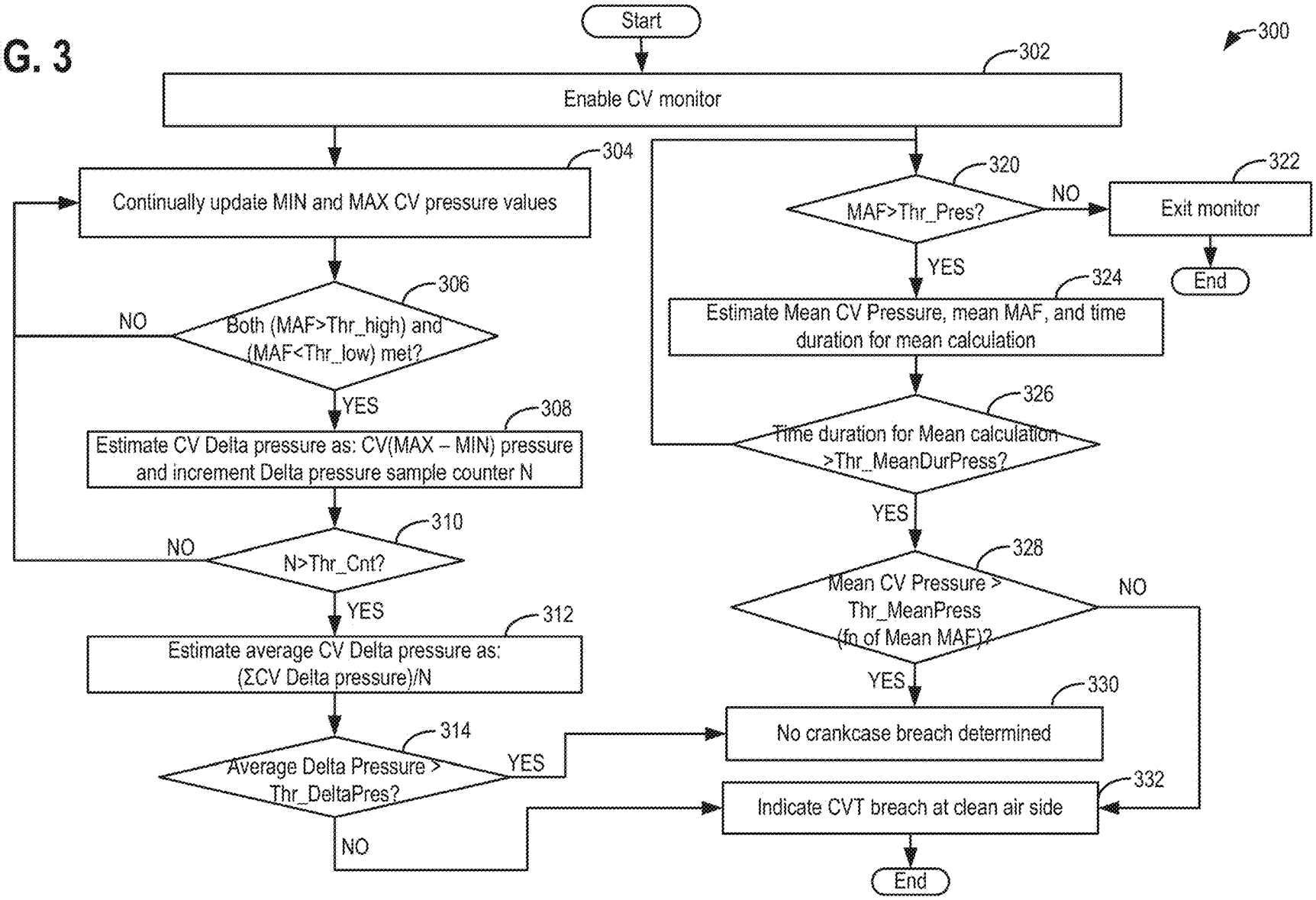
FIG. 3 shows a high level flow chart of an example method for indicating crankcase ventilation system breach, as well as a location of crankcase ventilation system breach, based on a correlation between crankcase vent tube pressure and manifold air flow.

Turning now to FIG. 3, an example method 300 is shown for diagnosing crankcase ventilation system breach due to disconnection of the CVT at the clean air side or due to a broken CVT hose. Instructions for carrying out method 300 may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

At 302, the method includes enabling the CV monitor. For example, the CV monitor can be enabled once the engine has completed cranking and the engine speed is higher than a cranking speed, such as above 400 rpm. From there, two monitors using two distinct metrics are run in parallel. A first monitor relies on Delta pressure, as shown at 304-314. Another monitor relies on Mean pressure, as shown at 320-328.

Turning to the first monitor, at 304, the method includes monitoring CV pressure and continually updating maximum and minimum CV pressure readings as driving progresses. Minimum CV pressure reading (MIN) and update occurs with each pedal tip-in when engine is boosted enough. Maximum pressure reading (MAX) and update occurs with each pedal tip-out when the engine is not boosted. The criteria of an engine transient having the necessary states of being boosted enough and being non-boosted is determined based on MAF sensor output. If the MAF sensor reading is greater than an upper threshold (Thr_high), it indicates that the engine has experienced enough boosting. If the MAF sensor reading is less than a lower threshold (Thr_low), it indicates non-boosted condition was experienced. In one example, the upper threshold is 450 kg/h and the lower threshold is 60 kg/h. Thus, the upper and lower thresholds of CV pressure are continually updated as long as MAF is below the upper threshold and above the lower threshold. How often the MAX and MIN CV pressure value updates occur may depend on a driver's pedal maneuver. If the MAF value is within the upper and lower threshold, the currently sampled CV pressure is compared to the most recently updated CV pressure MAX and MIN values. If the currently sampled CV pressure reading is higher than the most recently updated MAX value, the MAX value is updated to reflect the currently sampled CV pressure reading. If the currently sampled CV pressure reading is lower than the most recently updated MIN value, the MIN value is updated to reflect the currently sampled CV pressure reading.

Figure 4:
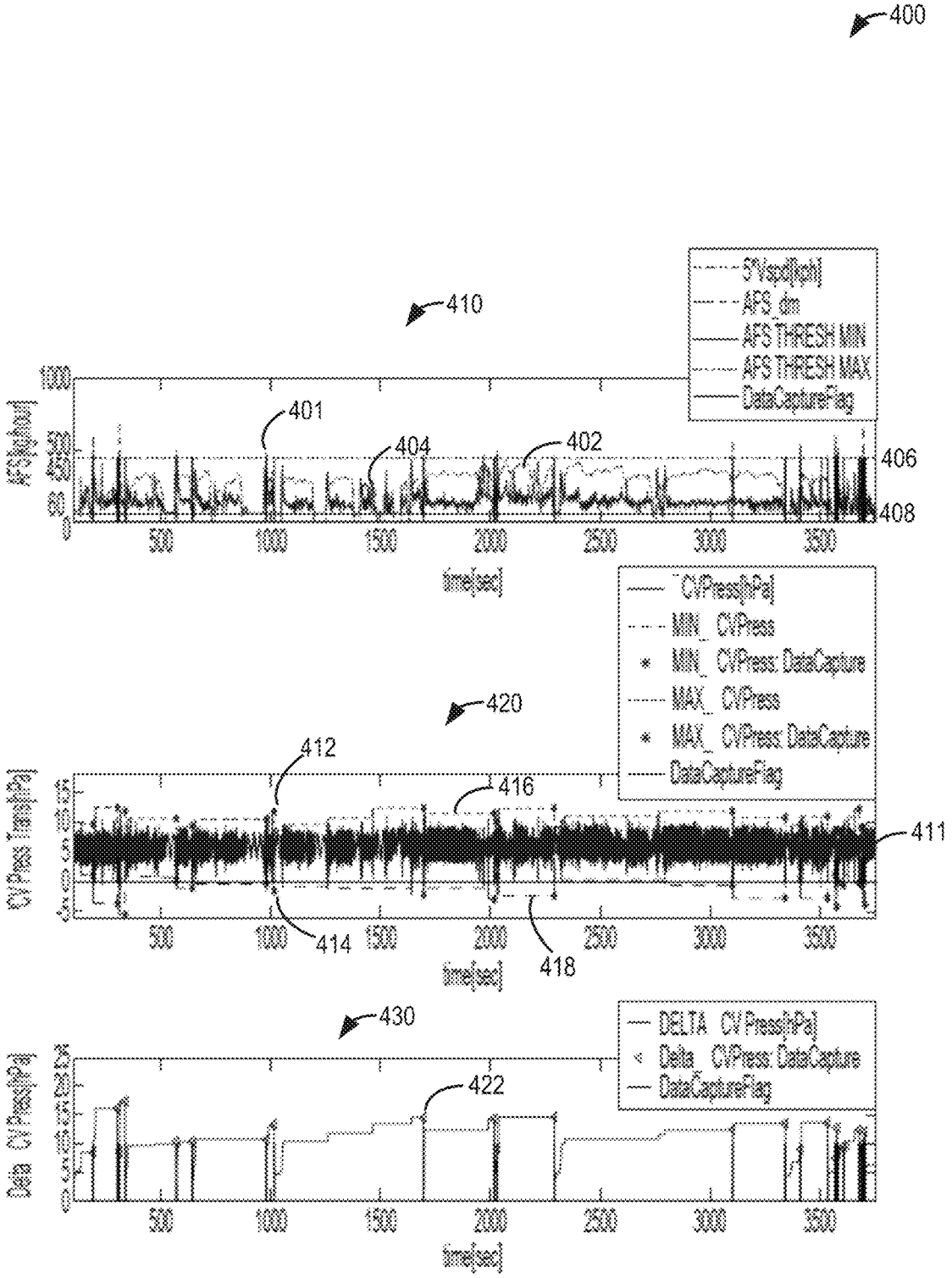
FIG. 4 shows example changes in CVT pressure and MAF during pedal transients in the absence of crankcase ventilation system breach.
Figure 5:
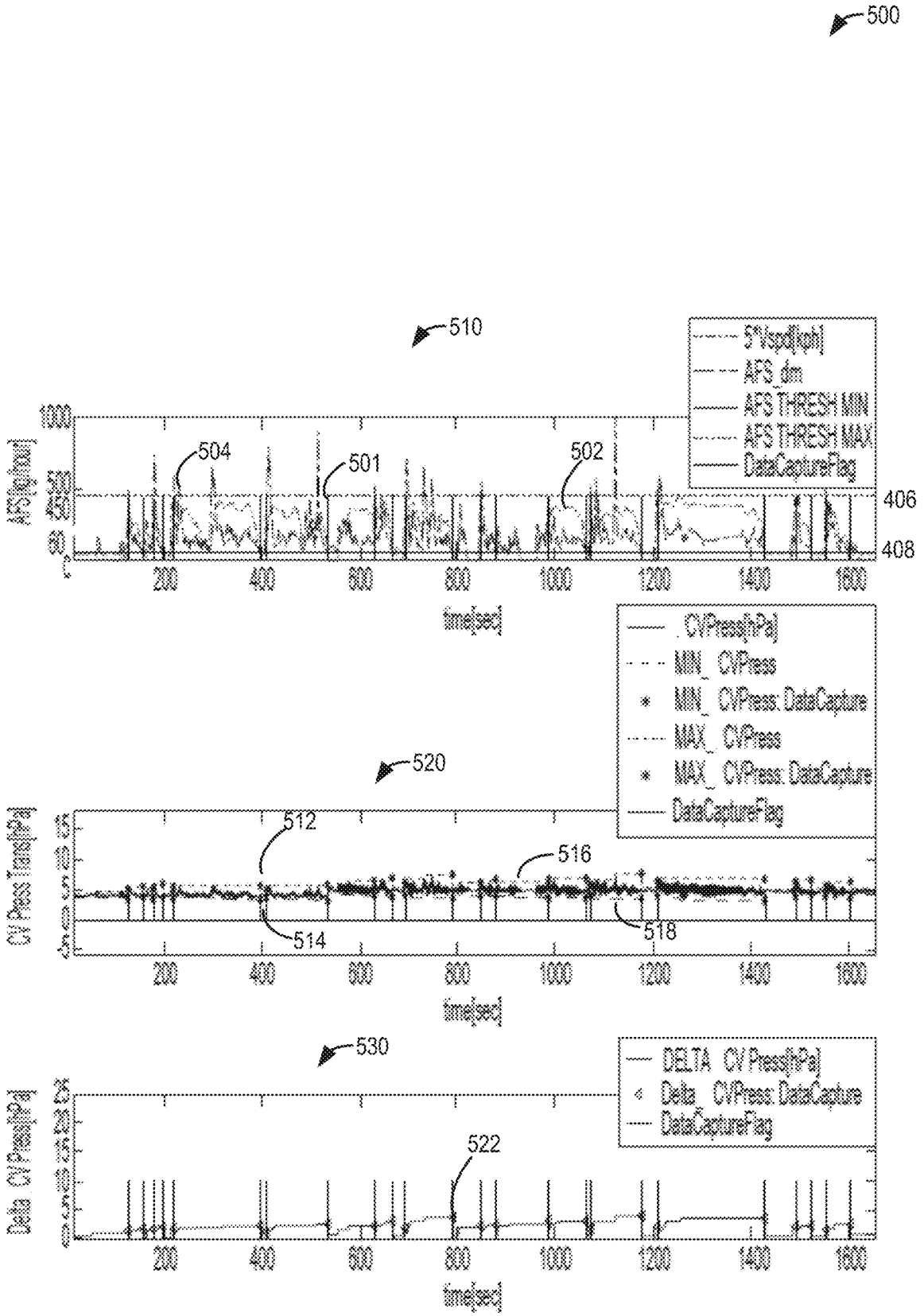
FIG. 5 shows example changes in CVT pressure and MAF during pedal transients in the presence of crankcase ventilation system breach.

An example of updating the MIN and MAX values is shown at FIGS. 4 and 5. Turning first to FIG. 4, map 410 shows MAF (plot 404) changing with vehicle speed (plot 402). The change in MAF is shown relative to upper and lower MAF thresholds 406 and 408, respectively. Changes is CV pressure over the corresponding duration is shown at map 420. Regions in between asterisks correspond to durations of continual monitoring of CV pressure and updating of MAX and MIN values 416 and 418, respectively. For example, between time points corresponding to 1500 and 1700 secs on map 420, MAX value 416 is increased while MIN value 418 is maintained. As another example, between time points corresponding to 1700 and 2000 secs on map 420, MAX value 416 is maintained while MIN value 418 is lowered.

Turning now to FIG. 5, map 510 shows MAF (plot 504) changing with vehicle speed (plot 502). The change in MAF is shown relative to upper and lower MAF thresholds 406 and 408, respectively. Changes is CV pressure over the corresponding duration is shown at map 520. Regions in between asterisks correspond to durations of continual monitoring of CV pressure and updating of MAX and MIN values 516 and 518, respectively. For example, between time points corresponding to 1100 and 1200 secs on map 520, MAX value 516 is increased while MIN value 518 is maintained. As another example, between time points corresponding to 400 and 600 secs on map 520, MAX value 516 is maintained while MIN value 518 is lowered.

Returning to FIG. 3, at 306, it may be determined if both the MAF criteria have been met. That is, it is determined if each of a higher than upper threshold MAF and a lower than lower threshold MAF has been experienced. Meeting of both low and high threshold criteria provides for the CV pressure sensor to have a chance to capture and update a delta CV pressure value based on the most recent minimum and maximum CV pressures readings. In one example, both criteria are met if a pedal transient involving both a heavy tip-in (e.g., higher than threshold pedal displacement on tip-in) and a heavy tip-out (e.g., higher than threshold pedal displacement on tip-out) happens, with the pedal tip-in and tip-out needing to be such that they induce MAF to increase past the upper threshold and MAF to decrease below the lower threshold. As such, this may include a heavy tip-in followed by a heavy tip-out, or a heavy tip-out followed by a heavy tip-in. When both criteria are met, a qualified pedal transient for estimating delta CV pressure is determined. If both criteria are not met, the method returns to 304 to continue updating the MAX or MIN thresholds. In other words, if only a heavy tip-in or only a heavy tip-out occurs, the routine returns to 304 to only update the missing MAX or MIN thresholds based on the CV pressure which will be captured at the following opportunity of heavy tip-in or heavy tip-out event. With reference to the maps of FIGS. 4 and 5, such an event where both criteria are met are indicated by asterisks at plots 420, 520 and by triangles at plots 430, 530.

At 308, responsive to each of MAF higher than the upper MAF threshold and below the lower MAF threshold, a delta CV pressure value is estimated. This includes learning a difference between the last estimated MIN and MAX values of CV pressure. By comparing the maximum measured pressure value to the minimum measured pressure value, a delta pressure corresponding to a widest CV pressure range achieved on the qualified pedal transient is determined. In addition, a delta pressure sample counter is incremented by 1. In this manner, multiple transient events can be monitored to calculate average delta pressure from multiple delta pressure estimations.

At 310, it is determined if the number of samples counted by the delta pressure sample counter is higher than a threshold count (Thr_Cnt). In one example, it may be confirmed that N samples are collected, such as at least 6 samples of CV delta pressure have been collected (that is, N=6). If not, the method returns to 304 to continue sampling CV pressure and calculating a CV delta pressure on qualified transients where MAF exceeds an upper threshold and falls below a lower threshold. If the threshold count is reached or exceeded, then at 312, the method includes estimating an average Delta pressure over the N samples. The average Delta pressure may be a statistical average. By comparing this average Delta pressure range to a threshold, the controller may infer if the vent tube is breached. In particular, at 314, it is determined if the estimated average Delta pressure is higher than a threshold pressure (Thr_DeltaPres). If the tube is disconnected on the clean air side or CVT broken, the pressure change may be smaller due to blow-by gases not being drawn in by air flowing through the intake compressor. Therefore, if the average Delta pressure is lower than the threshold pressure, at 332, it may be indicated that the CVT is breached. Indicating that the vent tube is breached includes indicating that the vent tube is disconnected or broken. The indication may be provided via the illumination of a malfunction indicator light and/or the setting of a diagnostic code. Else, if the average Delta pressure is higher than the threshold pressure, at 330, it may be indicated that no crankcase breach is present. By using average delta pressure for fail or pass decision provides a more reliable monitor and more accurate monitor results.

In some examples, the controller may record a number of crankcase breach detections to determine if a threshold number of breach detections have been reached. When the routine indicates a crankcase breach, the controller may store each instance of breach detection, and execute a notification once a threshold number of detections have been reached. The threshold may be one breach detection in some embodiments. In other embodiments, to increase accuracy, the threshold may be multiple breach detections, such as two, five, etc. Once the threshold number of breach detections is reached, a message may be displayed to the vehicle operator.

The mitigation actions taken in response to the indication of breach may include adjusting one or more operating parameters to limit engine issues that may occur during engine operation with a breached crankcase. For example, the mitigating actions may include acting to delay a depletion of lubricant from the crankcase if the crankcase is indicated to be breached. Other example mitigating actions include reducing an intake of air into the engine, limiting a speed or torque of the engine, limiting a throttle opening, and/or various other actions intended to limit an aspiration of engine lubricant from the breached crankcase. As yet another example, the mitigating action may further include adding lubricant to the crankcase. Maps 420, 430 of FIG. 4 shows a first scenario where there is no breach determined due to a higher than threshold difference CV delta pressure while maps 520, 530 shows a second scenario where breach is determined due to a higher than threshold CV delta pressure.

Turning now to the second monitor, at 320, it may be determined if MAF is higher than a threshold MAF (Thr_Pres), such as above 400 kg/h. This includes a condition when the engine experiences enough boost. When an engine experiences enough boost, which can be determined by MAF reading greater than a threshold, the CVT can be reliably diagnosed based on the mean CV pressure. If MAF is not higher than the threshold pressure, then at 322, the monitor exits.

Upon confirming that high MAF conditions are present, at 324, both of mean values of CV pressure and MAF are estimated for a predetermined time duration. At 326, it may be determined if the time duration for mean calculation is higher than a threshold duration (Thr_MeanDurPres). The duration may be satisfied in one long tip-in engine boosting event or over multiple short tip-in boosting events. In one example, the threshold duration is 3 seconds. If the duration condition is not satisfied, the method returns to 320 to continue monitoring for high MAF conditions. If the duration condition is satisfied at 328, the mean CV pressure can be compared to a threshold curve, whose curve is dependent on mean MAF. If mean CV pressure is less than a threshold value of mean pressure (Thr_MeanPres) that is determined as a function of the mean MAF, than at 330, the monitor may determine that there is no breach in the CV system. Otherwise, if the threshold pressure is exceeded, then the monitor can determine a breached CV system due to the CVT being disconnected at the clean air side or broken CVT. Due to the CVT being joined at the dirty air side to the oil separator and cannot be disconnected (without breakage occurring), any identification of breach is associated with disconnection at the clean air side (where the tube can be disconnected without breakage) or broken CVT. By assessing the mean CV pressure at larger mean MAF, which is when high engine boosted conditions occur, separation between breached and non-breached CV system is larger and allows for a more reliable monitor determination.

Figure 6:
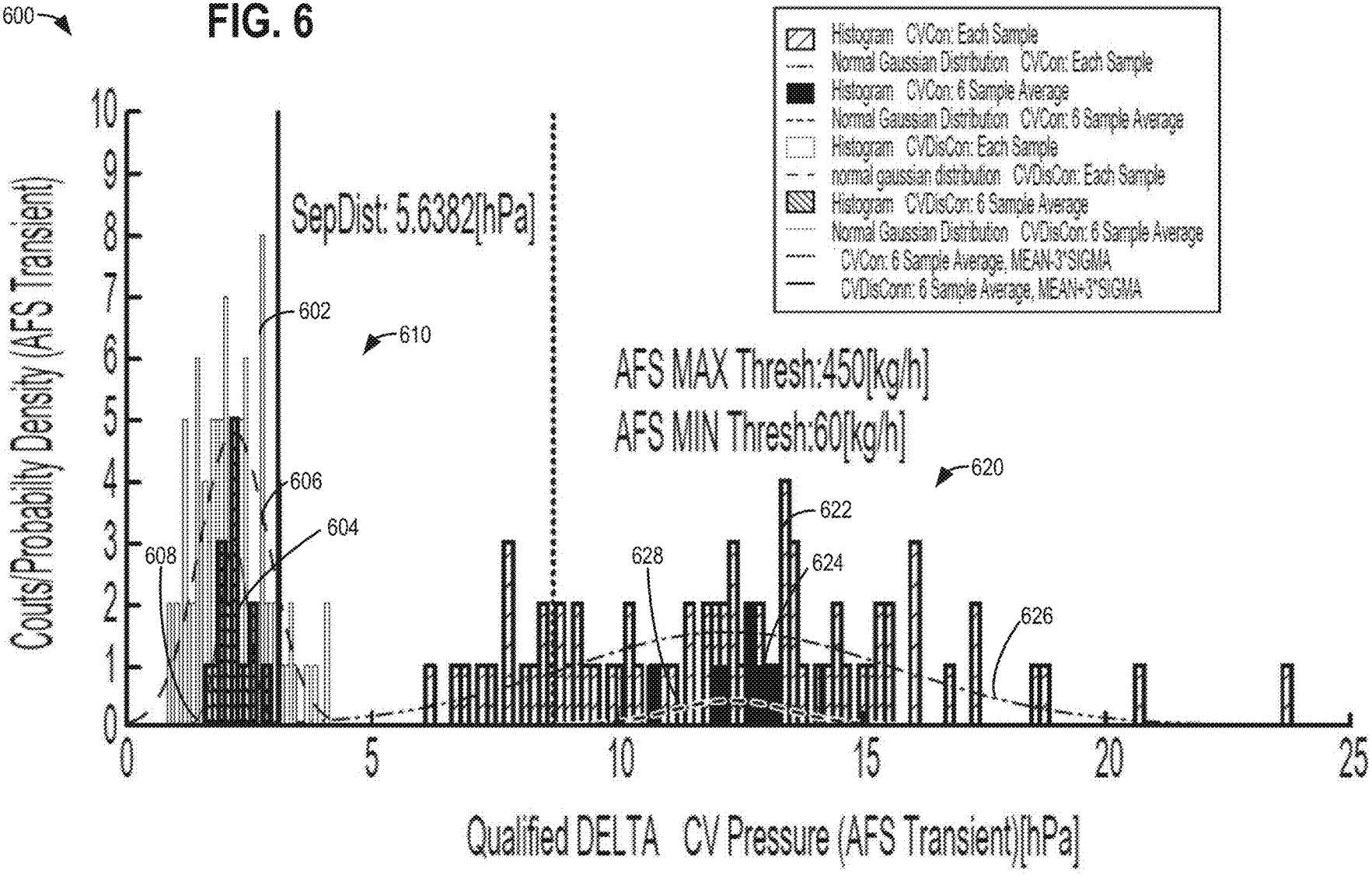
FIGS. 6-7 show example CVT pressure separation analyses in the presence and absence of crankcase ventilation system breach.
Figure 7:
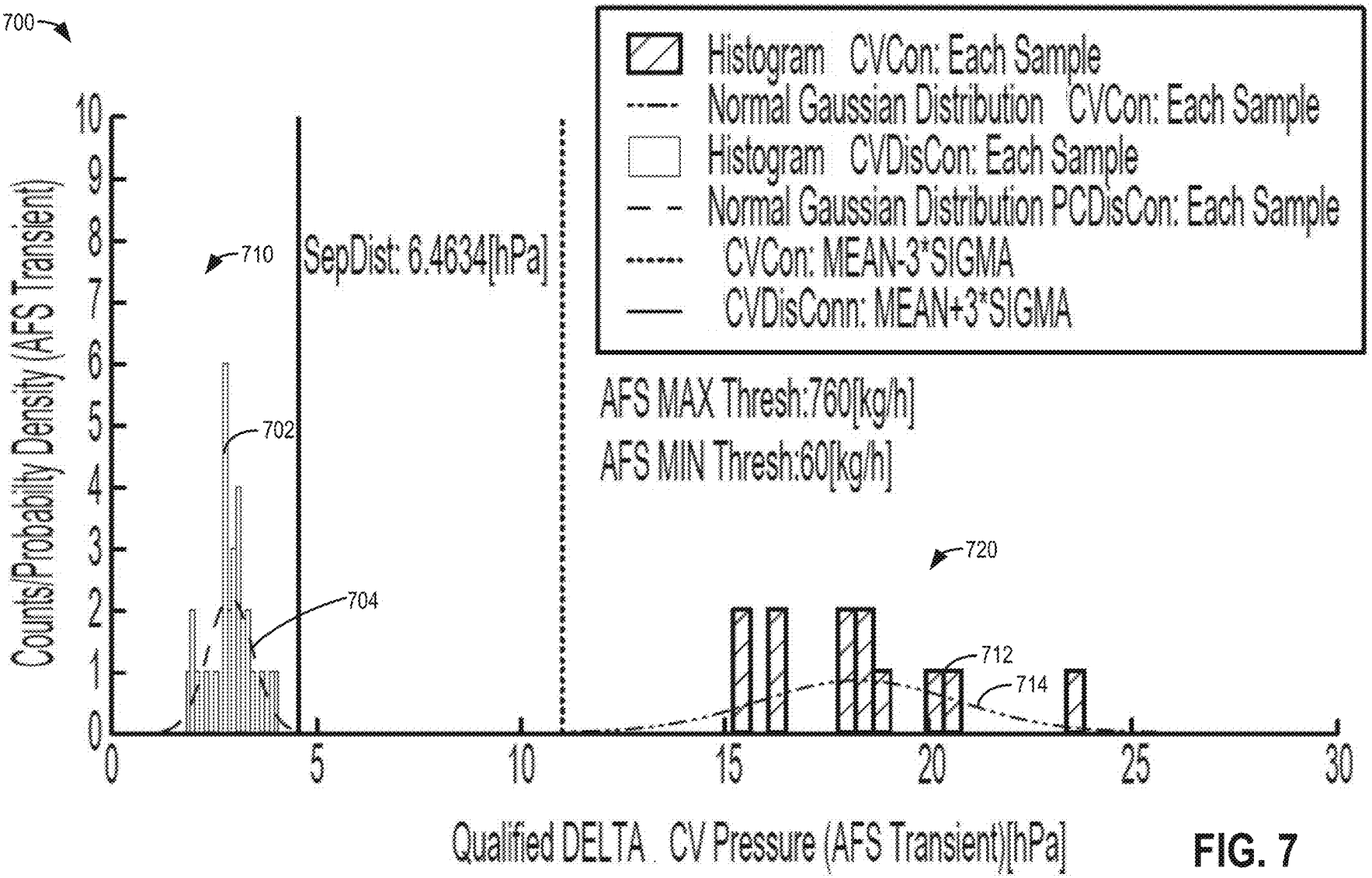

Turning now to FIGS. 4-5, an example CV monitor that relies on delta CV pressure as the metric is shown. In one example, the data obtained in FIGS. 4-5, as well as FIGS. 6-7, are based on data collected when performing the first metric shown in the method of FIG. 3, at 304-314. FIG. 4 depicts an example 400 wherein the CVT is not disconnected while FIG. 5 depicts an example 500 wherein the CVT is disconnected.

Example 400 includes a first map 410 that depicts vehicle speed over time at plot 402 (dashed line) and manifold air flow (MAF) over the same time, as estimated via a MAF sensor, at plot 404 (solid line). Upper and lower MAF thresholds, within which MAF and CV pressure are sampled, are shown at horizontal lines 406 (dashed line) and 408 (solid line), respectively. Line 401 shows the occurrence of a qualifying pedal transient which satisfies both of Upper and Lower MAF thresholds. One qualifying delta pressure is calculated at this time and stored to estimate mean delta pressure out of multiple transients of pedal tip-ins and outs. Multiple such events are shown by the plurality of lines 401 over the course of the drive cycle.

A second map 420 depicts CV pressure over time, as estimated via a pressure sensor coupled to the CVT, at plot 411. A maximum CV pressure sampled at qualifying transient 401 is shown by asterisk 412 and a minimum CV pressure sampled at the same qualifying transient 401 is shown by asterisk 414. Minimum and Maximum pressure value are continuously updated as long as new CV pressure readings are lower than the MIN CV pressure or higher than the MAX CV pressure as determined 304 in FIG. 3. When a MAF value is experienced outside of the upper and lower thresholds 406, 408, at least once respectively, that is when one qualified event is satisfied and one qualified delta pressure is captured.

Histogram 600, at FIG. 6, depicts the qualified delta pressure values captured at each qualifying event, as elaborated below.

A third map 430 depicts delta CV pressure for each qualifying transient over the same time of vehicle operation, as estimated based on a difference between the maximum and minimum CV pressure for the corresponding qualifying transient. Each triangular mark 422 marks each qualifying event when delta CV pressure is captured. Herein due to the average delta pressure captured over the plurality of samples being higher than a threshold, no crankcase breach is determined.

Example 500 includes a first map 510 that depicts vehicle speed over time at plot 502 (dashed line) and manifold air flow (MAF) over the same time, as estimated via a MAF sensor, at plot 504 (solid line). Upper and lower MAF thresholds, within which MAF and CV pressure are sampled, are shown at horizontal lines 406 (dashed line) and 408 (solid line), respectively. Line 501 shows the occurrence of a qualifying pedal transient which satisfies both of Upper and Lower MAF thresholds. One qualifying delta pressure is calculated at this time and stored to estimate mean delta pressure out of multiple transients of pedal tip-ins and outs. Multiple such events are shown by the plurality of lines 501 over the course of the drive cycle.

A second map 520 depicts CV pressure over time, as estimated via a pressure sensor coupled to the CVT, at plot 511. A maximum CV pressure sampled at qualifying transient 501 is shown by asterisk 512 and a minimum CV pressure sampled at the same qualifying transient 501 is shown by asterisk 514. Minimum and Maximum pressure value are continuously updated as long as new CV pressure readings are lower than the MIN CV pressure or higher than the MAX CV pressure. When a MAF value is experienced outside of the upper and lower thresholds 406, 408, at least once respectively, that is when one qualified event is satisfied and one qualified delta pressure is captured.

Histogram 600, at FIG. 6, depicts the qualified delta pressure values captured at each qualifying event, as elaborated below.

A third map 530 depicts delta CV pressure for each qualifying transient over the same time of vehicle operation, as estimated based on a difference between the maximum and minimum CV pressure for the corresponding qualifying transient. Each triangular mark 522 marks each qualifying event when delta CV pressure is captured.

Herein due to the average delta pressure captured over the plurality of samples being lower than the threshold, crankcase breach is determined.

Turning now to FIG. 6, map 600 includes histograms 610 and 620 which depict example separation analyses of CV delta pressure in the presence and absence of crankcase breach, respectively. There are two different separation analyses represented at FIG. 6. A first separation analysis for each delta CV pressure samples without estimating average CV delta pressure is shown by histogram bars 602 (depicting the absence of crankcase breach) and histogram bars 622 (depicting the presence of crankcase breach. Individual (single) samples are depicted by individual bars 602 and 622. A second separation analysis is obtained by averaging 6 qualified CV delta pressure samples and shown by histogram bars 604 (depicting the absence of crankcase breach) and histogram bars 624 (depicting the presence of crankcase breach). MAF Thresholds are set to: MAF MIN Threshold=60 [kg/h] and MAF MAX Threshold=450 [kg/h]. Normal Gaussian distribution curves for breached (plot 626) and non-breached (plot 606) slightly overlaps at around 4.5 [hpa] CV delta pressure indicating there is potential risk for false monitor determination (i.e., 6 SIGMA separation is not achieved). However, when 6 samples of qualifying CV delta pressure values are averaged for separation, it is improved significantly. This is represented by plots 608 and 628, respectively As shown, the 6 sample average Delta Pressure achieves 3 SIGMA separation with SepDist of 5.6382 [hPa]. Single (Each) sample Delta Pressure case does not result in 3 SIGMA separation, which may be set as the threshold for monitor in this case.

It will be appreciated that as used herein, the separation distance is defined as the distance between 3×SIGMA lines of CV connected and disconnected 6 sample average Delta Pressure values.

Turning now to FIG. 7, map 700 includes histograms 710 and 720 which depict example separation analyses of PCV delta pressure in the presence and absence of crankcase breach, respectively for a single sample.

Individual (single) samples are depicted by individual bars 702 and 712. Average Delta Pressure case for the single event is shown by lines 704 and 714. MAF Thresholds for MIN and MAX are set to require a larger MAF transient than required in the example of FIG. 6. For a single acquisition of Delta Pressure Metric, the MAF MIN Threshold is set to 60 [kg/h], while the MAF MAX Threshold is set to 760 [kg/h]. As shown, without averaging the Delta Pressure value (that is, by just using a single Delta Pressure value), a 3 SIGMA separation is achieved with Separation Distance of 6.4634[hPa]. The separation distance achieved in the example of FIG. 7 is bigger than the corresponding value in the example of FIG. 6 (specifically, 6.4634 vs. 5.6382 [hPa]) indicating increasing Upper MAF threshold can improve separation. However, it reduces opportunity for monitor since it requires pedal tip-in event with higher engine boost. OBD regulation requires to meet certain level of monitor frequency. As such, a balance between separation distance and monitor frequency is needed.

In the scenario depicted in FIG. 6, with the example of 6 samples being averaged, a moderate tip-in pedal acceleration of 6 times of MAF can reach 450 [kg/h] may complete the monitor. However, in FIG. 7 case with MAF upper threshold of 760 [kg/h], one harder tip-in pedal acceleration is needed to complete a monitor. Depending on a pattern of each driver's driving habits or traffic conditions, one may be more easily encountered than the other. This affects monitor completion efficiency.

Figure 8:
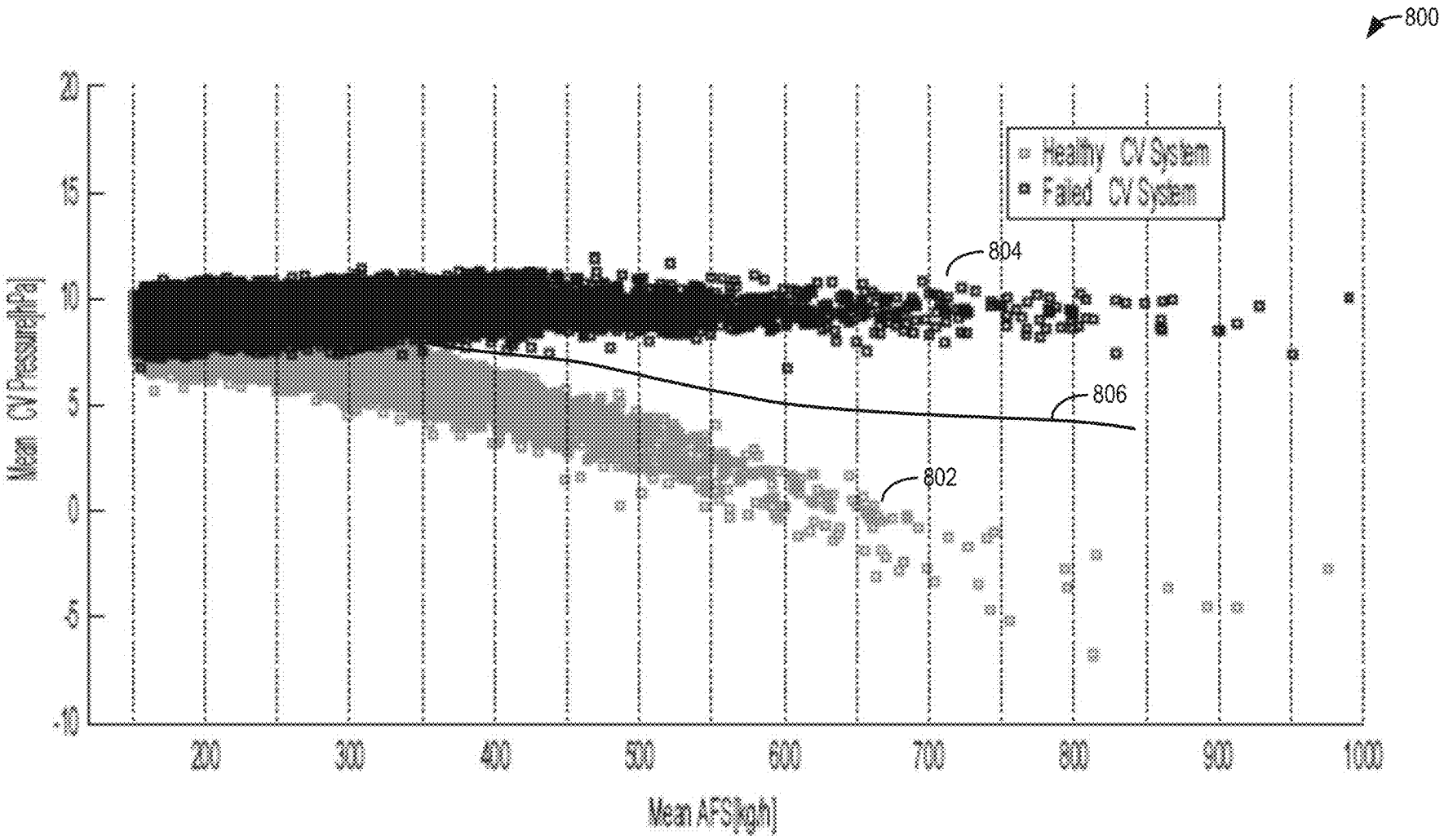
FIG. 8 shows an example map comparing mean CVT pressure and MAF values in the presence and absence of crankcase ventilation system breach.
Figure 9:
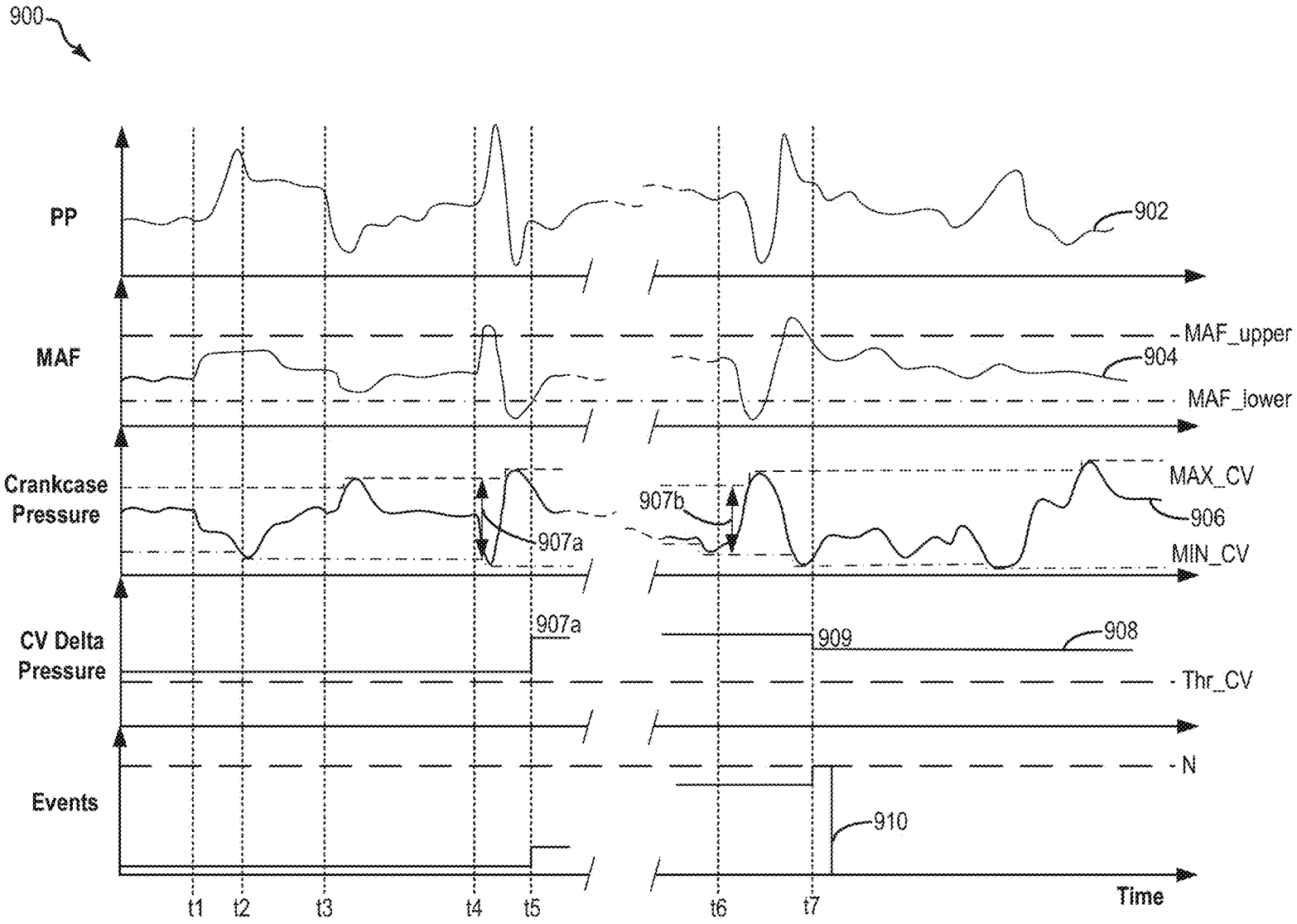
FIG. 9 shows a prophetic example of crankcase pressure monitoring for crankcase breach detection.

Turning now to FIG. 8, an example CV monitor that relies on mean CV pressure as the metric is shown. In one example, the data obtained in FIG. 8 is based on data collected when performing the second metric of method FIG. 3 at 320-328. Map 800 depicts mean CV pressure along the y-axis and mean MAF along the x-axis. Map 800 depicts data captured wherein the CVT is not disconnected at 802 to data captured when the CVT is disconnected at 804.

Each data point (represented as a square) depicts a Mean value of MAF or CV Pressure signal, averaged over a 3 sec duration. When MAF is greater than about 400 [kg/hr], separation between CV unbreached system (802) and breached (804) is possible. Separation between scenario 802 and 804 becomes larger as MAF becomes larger, as indicated by the threshold line 806 that demarcates a breached and an unbreached CV system, threshold 806 determined as a function of Mean AFS FIG. 9 shows a prophetic example of CV pressure monitoring over a drive cycle, and use of CV pressure data for identification of a crankcase breach due to disconnection of a crankcase vent tube. Map 900 depicts pedal position at plot 902. Pedal position is representative of operator torque demand. Manifold air flow (MAF) as sensed by a MAF sensor of the engine intake is shown at plot 904. The sensed MAF is compared to an upper threshold (MAF_upper, dashed line) and a lower threshold (MAF_lower, dashed and dotted line). Crankcase pressure, as sensed by a pressure sensor coupled in a crankcase vent tube, is shown at plot 906. Each of a maximum value of crankcase pressure (MAX_CV, dashed line) and a minimum value of crankcase pressure (MAX_CV, dashed and dotted line) are continuously updated based on changes in the sensed crankcase pressure. A crankcase delta pressure, or maximum pressure range, is shown at plot 908. The delta pressure is learned at qualifying pedal events as a difference between a last updated maximum and minimum value of crankcase pressure. The qualifying events are tracked by a counter whose output is shown at plot 910. All plots are shown over time along the x-axis.

Prior to t1, the vehicle is moving with the engine operating in steady-state. MAF is within a range defined by the upper and lower thresholds. Crankcase pressure is changing with changing engine operating conditions. Specifically, crankcase pressure changes in an inverse relation to MAF, with the crankcase pressure increasing when MAF decreases, and the crankcase pressure decreasing when MAF increases. However, the maximum crankcase pressure sensed before t1 continues to be lower than a last updated maximum value of crankcase pressure, and therefore the last updated value of maximum pressure is retained. Likewise, the minimum crankcase pressure continues to be held at the last updated value. No qualifying events for delta pressure estimation have occurred thus far, as indicated at plot 910. The crankcase delta pressure estimated for the less than threshold number of qualifying events is higher than a threshold Thr_CV Between t1 and t2, there is a pedal tip-in. The transient increase in torque demand results in an increase in MAF, however, MAF remains below the upper threshold (MAF_upper). Crankcase pressure reaches a new minimum value (lower than the last updated value) and accordingly the MIN_CV line is updated after t2 to reflect the new lower minimum value. The maximum value remains the same as the current maximum crankcase pressure is not higher than the last updated value. Between t2 and t3, there is a pedal tip-out. The transient decrease in torque demand results in a decrease in MAF, however, MAF remains above the lower threshold (MAF_lower). Crankcase pressure reaches a new maximum value (higher than the last updated value) and accordingly the MAX_CV line is updated after t3 to reflect the new higher maximum value. The minimum value remains the same as the current maximum crankcase pressure is not lower than the last updated value.

Between t3 and t4, there are multiple other transients where MAF remains within the range. In this time frame, no additional changes to MAX_CV and MIN_CV are made since crankcase pressure values do not overshoot the last updated values.

Between t4 and t5, there is a first qualifying transient which includes a heavy tip-in and a heavy tip-out. In particular, the transient results in MAF falling below the lower threshold and then exceeding the upper threshold. As a result, this transient qualifies for delta pressure measurement. Accordingly, at t5, the event counter is incremented by 1. At this time the maximum and minimum values of crankcase pressure are updated to reflect the crankcase pressure exceeding the last learned maximum value and falling below the last learned minimum value. Further, a first pressure difference 907*a* between the last updated values of minimum and maximum crankcase pressure (at the time of the qualifying event) is learned and used to update the delta pressure estimate at the first qualifying event. Specifically, at t5, the crankcase delta pressure estimate is readjusted to reflect the difference 907*a*. This learned value is higher than threshold_CV.

Multiple such events including updating of the MAX_CV and MIN_CV values as well as capture of a difference between the maximum and minimum values (indicative of a maximum range of the sensed crankcase pressure) occur between t5 and t6. The counter is accordingly incremented.

Between t6 and t7, there is another qualifying transient which includes a heavy tip-in and a heavy tip-out. Unlike the event between t4 and t5 which had a heavy tip-in followed by a heavy tip-out, the event at t6-t7 has a heavy tip-out followed by a heavy tip-in. Nonetheless, the transient results in MAF exceeding the upper threshold and falling below the lower threshold. Therefore this transient qualifies for delta pressure measurement. Accordingly, shortly after t7, the event counter is incremented and it reaches the threshold number N. At this time the maximum and minimum values of crankcase pressure are updated to reflect the crankcase pressure exceeding the last learned maximum value and falling below the last learned minimum value. Further, a difference 907*b* between the last updated values of minimum and maximum crankcase pressure is learned. Further, the delta pressure estimate is updated to a value 909 which is determined as an average of all the values learned at each of the qualifying events starting from the first event at t4-t5. Specifically, average value 909 is determined as an average of the first delta pressure difference 907*a* captured at the first qualifying event, the Nth delta pressure difference 907*n* captured at the Nth qualifying event, and all interim captures. For example, delta pressure difference 909 may be determined as:

Average CV Delta pressure difference 909=(delta pressure difference 907*a*,delta pressure 907*n-i*, delta pressure difference 907*n*)*1\N.

After t7, the crankcase delta pressure estimate is readjusted to reflect the new average difference 909. Since the delta pressure continues to be higher than threshold_CV, no breach is indicated. The monitor then ends.

After t7, the counter is restarted. Also, capture of crankcase pressure and updating of MAX_CV and MIN_CV values is restarted. In this way, by using an existing pressure sensor positioned within a crankcase vent tube, and an intake manifold air flow sensor, changes in pressure through the vent tube can be correlated with changes in manifold air flow to reliably diagnose a CV system. The technical effect of relying on changes in crankcase vent tube pressure and manifold air flow during pedal transients that result in a significantly large change in engine air flow is that disconnection of the vent tube from the engine intake, downstream of an air filter and upstream of a compressor, can be reliably identified. The metrics presented may not reliably detect disconnection occurring at a side of vent tube couple to the crankcase. Therefore, the methodology presented requires the tube coupled to the crankcase shall be designed as non-detachable way.

An example engine method comprises: following each of a first set of qualifying pedal transients of a drive cycle, updating a minimum and maximum value of crankcase pressure; following each of a second set of qualifying pedal transients of the drive cycle, learning a pressure difference between a last updated minimum and maximum value of crankcase pressure; and indicating degradation in crankcase ventilation based on an average pressure difference over the second set. In the preceding example, additionally or optionally, during the first set of qualifying pedal transients, a manifold air flow is within a range defined by an upper threshold and a lower threshold, and wherein during the second set of qualifying pedal transients, the manifold airflow is outside the range. In any or all of the preceding examples, additionally or optionally, the method further comprises estimating the average pressure difference over the second set after a threshold number of qualifying pedal transients having manifold airflow outside the range are identified. In any or all of the preceding examples, additionally or optionally, the first set of qualifying pedal transients include one of a lower than threshold tip-in and a lower than threshold tip-out, and wherein the second set of qualifying pedal transients include each of a higher than threshold tip-in and a higher than threshold tip-out. In any or all of the preceding examples, additionally or optionally, the indicating includes indicating a presence of breach when the average pressure difference is lower than a threshold, and indicating an absence of breach when the average pressure difference is higher than the threshold. In any or all of the preceding examples, additionally or optionally, indicating the presence of breach includes indicating that a crankcase ventilation tube coupling an engine crankcase to an engine intake is disconnected from an air intake passage, upstream of an intake compressor. In any or all of the preceding examples, additionally or optionally, the method further comprises monitoring crankcase pressure over the drive cycle after completion of engine cranking. In any or all of the preceding examples, additionally or optionally, the updating includes: if the crankcase pressure learned during a transient of the first set of qualifying pedal transients is higher than a last learned maximum value of crankcase pressure, updating the maximum value, or if the crankcase pressure learned during the transient of the first set is lower than a last learned minimum value of crankcase pressure, updating the minimum value; else, maintaining the last learned maximum and minimum value of crankcase pressure. In any or all of the preceding examples, additionally or optionally, the method further comprises measuring each of the crankcase pressure and the manifold air flow for a duration on each pedal transient where manifold air flow is above the upper threshold and above the lower threshold; and indicating crankcase breach responsive to a mean value of the measured crankcase pressure over the duration being smaller than a threshold pressure, the threshold pressure determined as a function of a mean value of the manifold air flow over the duration.

Another example method comprises: during a first number of pedal transients where manifold air flow is within a range, updating maximum and minimum values of crankcase pressure based on crankcase pressure sensor output; during a second number of pedal transients where manifold air flow is outside the range, estimating a delta pressure based on last updated maximum and minimum values of crankcase pressure; and indicating crankcase breach responsive to the delta pressure, averaged over the second number, being lower than a threshold value. In any or all of the preceding examples, additionally or optionally, the method further comprises, initiating estimation of crankcase vent tube pressure after engine cranking and discontinuing estimation of crankcase vent tube pressure after the second number of pedal transients is satisfied. In any or all of the preceding examples, additionally or optionally, the first number of pedal transients where manifold air flow is within the range include manifold air flow between an upper threshold and a lower threshold, and wherein the second number of pedal transients where manifold air flow is outside the range include manifold air above the upper threshold and below the lower threshold. In any or all of the preceding examples, additionally or optionally, the method further comprises: measuring each of crankcase vent tube pressure and manifold air flow for a duration while manifold air flow is above the upper threshold and above the lower threshold; and indicating crankcase breach responsive to a mean value of the measured crankcase vent tube pressure over the duration relative to a threshold pressure, the threshold pressure determined as a function of a mean value of the manifold air flow over the duration. In any or all of the preceding examples, additionally or optionally, indicating crankcase breach includes setting a diagnostic code to indicate that a crankcase vent tube is disconnected from an air intake passage or CVT broken, downstream of an air filter and upstream of an intake compressor.

Another example engine system comprises: a pedal for receiving an operator torque demand; an engine including an intake manifold and a crankcase; a crankcase vent tube mechanically connected to the intake manifold upstream of a compressor, the tube also mechanically connected to the crankcase via an oil separator, the vent tube located external to the engine; a pressure sensor coupled in the crankcase vent tube for sensing crankcase pressure; an air flow sensor coupled to the intake manifold; and a controller with computer readable instructions stored on non-transitory memory that when executed cause the controller to: indicate disconnection of the vent tube or broken CVT responsive to a mean crankcase pressure being lower than a threshold value, the mean crankcase pressure estimated over a duration while manifold air flow exceeds an upper threshold; and indicate disconnection of the vent tube or broken CVT responsive to an average crankcase pressure range being lower than another threshold value, the average crankcase pressure range estimated over a number of pedal transients where manifold air flow exceeds the upper threshold and falls below a lower threshold. In any or all of the preceding examples, additionally or optionally, the number of pedal transients is selected as a function of the another threshold value, the number increased as the another threshold value decreases, and wherein the integrated duration is integrated over one or multiple pedal transients where manifold air flow exceeds the upper threshold. In any or all of the preceding examples, additionally or optionally, the controller includes further instructions that cause the controller to: update a maximum and minimum value of a crankcase pressure range on each pedal transient of a drive cycle where manifold air flow remains within the upper and the lower threshold; and estimate the average crankcase pressure range over the number of pedal transients where manifold air flow exceeds the upper threshold and falls below the lower threshold as a difference between a last updated maximum and minimum value of the crankcase pressure range. In any or all of the preceding examples, additionally or optionally, the number of pedal transients include each of a pedal tip-in with a higher threshold pedal displacement and a pedal tip-out with the higher threshold pedal displacement. In any or all of the preceding examples, additionally or optionally, the controller includes instructions that, responsive to the indication of vent tube disconnection or broken CVT, illuminate a malfunction indicator light, and limit an engine load by limiting manifold air flow through an intake throttle. In another representation, the engine system is coupled to a hybrid vehicle system.

In a further representation, an engine method comprises: monitoring crankcase vent tube pressure to identify each of a minimum pressure value, a maximum pressure value, and a delta pressure for each of a plurality of qualifying pedal transients of a drive cycle, the delta pressure based on the minimum and the maximum pressure value; and indicating crankcase ventilation system degradation based on an average delta pressure of the plurality of qualifying pedal transients of the drive cycle.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine method, comprising:

following each of a first set of qualifying pedal transients of a drive cycle, updating a minimum and maximum value of crankcase pressure;

following each of a second set of qualifying pedal transients of the drive cycle, learning a pressure difference between a last updated minimum and maximum value of crankcase pressure; and indicating degradation in crankcase ventilation based on an average pressure difference over the second set.

2. The method of claim 1, wherein during the first set of qualifying pedal transients, a manifold air flow is within a range defined by an upper threshold and a lower threshold, and wherein during the second set of qualifying pedal transients, the manifold airflow is outside the range.

3. The method of claim 2, further comprising, estimating the average pressure difference over the second set after a threshold number of qualifying pedal transients having manifold airflow outside the range are identified.

4. The method of claim 1, wherein the first set of qualifying pedal transients include one of a lower than threshold tip-in and a lower than threshold tip-out, and wherein the second set of qualifying pedal transients include each of a higher than threshold tip-in and a higher than threshold tip-out.

5. The method of claim 1, wherein the indicating includes indicating a presence of breach when the average pressure difference is lower than a threshold, and indicating an absence of breach when the average pressure difference is higher than the threshold.

6. The method of claim 2, wherein indicating the presence of breach includes indicating that a crankcase ventilation tube coupling an engine crankcase to an engine intake is broken or disconnected from an air intake passage, upstream of an intake compressor.

7. The method of claim 1, further comprising, monitoring crankcase pressure over the drive cycle after completion of engine cranking.

8. The method of claim 2, wherein the updating includes:

if the crankcase pressure learned during a transient of the first set of qualifying pedal transients is higher than a last learned maximum value of crankcase pressure, updating the maximum value, or if the crankcase pressure learned during the transient of the first set is lower than a last learned minimum value of crankcase pressure, updating the minimum value;

else, maintaining the last learned maximum and minimum value of crankcase pressure.

9. The method of claim 2, further comprising: measuring each of the crankcase pressure and the manifold air flow for a duration on each pedal transient where manifold air flow is above the upper threshold and above the lower threshold; and indicating crankcase breach responsive to a mean value of the measured crankcase pressure over the duration being smaller than a threshold pressure, the threshold pressure determined as a function of a mean value of the manifold air flow over the duration.

10. A method, comprising:

during a first number of pedal transients where manifold air flow is within a range, updating maximum and minimum values of crankcase pressure based on crankcase pressure sensor output;

during a second number of pedal transients where manifold air flow is outside the range, estimating a delta pressure based on last updated maximum and minimum values of crankcase pressure; and indicating crankcase breach responsive to the delta pressure, averaged over the second number, being lower than a threshold value.

11. The method of claim 10, further comprising, initiating estimation of crankcase vent tube pressure after engine cranking and discontinuing estimation of crankcase vent tube pressure after the second number of pedal transients is satisfied.

12. The method of claim 10, wherein the first number of pedal transients where manifold air flow is within the range include manifold air flow between an upper threshold and a lower threshold, and wherein the second number of pedal transients where manifold air flow is outside the range include manifold air above the upper threshold and below the lower threshold.

13. The method of claim 12, further comprising:

measuring each of crankcase vent tube pressure and manifold air flow for a duration while manifold air flow is above the upper threshold and above the lower threshold; and indicating crankcase breach responsive to a mean value of the measured crankcase vent tube pressure over the duration relative to a threshold pressure, the threshold pressure determined as a function of a mean value of the manifold air flow over the duration.

14. The method of claim 13, wherein indicating crankcase breach includes setting a diagnostic code to indicate that a crankcase vent tube is broken or disconnected from an air intake passage, downstream of an air filter and upstream of an intake compressor.

15. The method of claim 13, further comprising, responsive to the indication of crankcase breach, adjusting one or more engine operating parameters to limit engine torque.

16. An engine system, comprising:

a pedal for receiving an operator torque demand;

an engine including an intake manifold and a crankcase;

a crankcase vent tube mechanically connected to the intake manifold upstream of a compressor, the tube also mechanically connected to the crankcase via an oil separator, the vent tube located external to the engine;

a pressure sensor coupled in the crankcase vent tube for sensing crankcase pressure;

an air flow sensor coupled to the intake manifold; and a controller with computer readable instructions stored on non-transitory memory that when executed cause the controller to:

indicate vent tube breach responsive to a mean crankcase pressure being lower than a threshold value, the mean crankcase pressure estimated over an integrated duration while manifold air flow exceeds an upper threshold; and indicate vent tube breach responsive to an average crankcase pressure range being lower than another threshold value, the average crankcase pressure range estimated over a number of pedal transients where manifold air flow exceeds the upper threshold and falls below a lower threshold.

17. The system of claim 16, wherein the number of pedal transients is selected as a function of the another threshold value, the number increased as the another threshold value decreases, and wherein the integrated duration is integrated over one or multiple pedal transients where manifold air flow exceeds the upper threshold.

18. The system of claim 16, wherein the controller includes further instructions that cause the controller to:

update a maximum and minimum value of a crankcase pressure range on each pedal transient of a drive cycle where manifold air flow remains within the upper and the lower threshold; and estimate the average crankcase pressure range over the number of pedal transients where manifold air flow exceeds the upper threshold and falls below the lower threshold as a difference between a last updated maximum and minimum value of the crankcase pressure range.

19. The system of claim 16, wherein the number of pedal transients include each of a pedal tip-in with a higher threshold pedal displacement and a pedal tip-out with the higher threshold pedal displacement.

20. The system of claim 16, wherein the controller includes instructions that, responsive to the indication of vent tube breach, illuminate a malfunction indicator light, and wherein the indication of vent tube breach includes indicating that the vent tube is broken or disconnected.

* * * * *